US005689927A

United States Patent [19]

Knight, Sr.

[11] Patent Number: 5,689,927

[45] Date of Patent: Nov. 25, 1997

[54] CONCRETE POST USABLE WITH A SOUND BARRIER FENCE

[76] Inventor: Larry E. Knight, Sr., P.O. Box 187, Glyndon, Md. 21071

[21] Appl. No.: 787,105

[22] Filed: Jan. 22, 1997

[51] Int. Cl.[6] ..... E02D 27/42

[52] U.S. Cl. ..... 52/297; 52/296; 52/169.9; 52/741.13; 52/741.15; 52/745.17; 405/239; 248/523; 256/1; 256/13.1; 256/24; 181/210; 181/284

[58] Field of Search ..... 52/297, 296, 294, 52/298, 293.1, 169.9, 741.13, 741.14, 741.15, 745.05, 745.17; 405/239, 229; 248/519, 523; 256/13.1, 24, 1; 181/210, 284, 285, 296

[56] References Cited

U.S. PATENT DOCUMENTS

| | | | |
|---|---|---|---|
| 1,553,785 | 9/1925 | Ley | 52/297 |
| 3,193,255 | 7/1965 | Burdett | 52/298 X |
| 4,272,929 | 6/1981 | Hanson | 52/296 X |
| 4,365,451 | 12/1982 | Nelson | 52/169.9 |
| 4,627,211 | 12/1986 | Foster | 405/239 X |
| 4,674,593 | 6/1987 | McCarty | 181/210 |
| 4,793,110 | 12/1988 | Tucker | 52/169.9 X |
| 4,862,992 | 9/1989 | Melfi | 181/488 |
| 4,887,691 | 12/1989 | Rotondo | 181/210 |
| 5,400,997 | 3/1995 | Payne et al. | 52/297 |
| 5,426,267 | 6/1995 | Underhill et al. | 181/210 |
| 5,542,785 | 8/1996 | Cloud | 52/169.9 X |

*Primary Examiner*—Robert Canfield
*Attorney, Agent, or Firm*—Eli Lieberman

[57] ABSTRACT

A post having particular utility for use in a highway sound barrier wherein a number of posts are set along the highway to support acoustical panels. Each post is made of reinforced precast concrete having side channels to mount the acoustical panels. The posts are supported on poured concrete footings having a tapered depression in the top surface which is reinforced by a surrounding array of closed loop reinforcing rods. The post is inserted in the depression and bonded thereto by a quick setting grout.

13 Claims, 3 Drawing Sheets

CONCRETE POST USABLE WITH A SOUND BARRIER FENCE

BACKGROUND OF THE INVENTION

This invention relates to a concrete post for supporting large loads such as found in sound barriers which must be able to withstand wind loading in excess of 70 m.p.h. Noise generated by high speed traffic through heavily populated residential neighborhoods has become an environmental problem in many areas of the country. To cope with this problem, sound barriers have been erected on both sides of a highway to reflect and absorb sound energy and reduce the amount propagated into residential neighborhoods.

A typical sound barrier is formed of concrete footings spaced 15 or more feet apart. A steel or concrete post in the general shape of an I-beam with lateral channels is set in wet concrete and secured in a vertical position while the concrete hardens. After a period of time sufficient for the concrete to cure and support a load, sound reflecting and absorbing panels are inserted in the channels between adjacent posts. In a variation, a base plate with anchor bolts embedded in the concrete is provided on the upper surface of the footing. The posts supporting the panels are bolted to the base plate.

The above systems and variations thereof presently practiced are labor intensive, requiring an inordinate amount of time between setting up the support posts and mounting the panels. Given that these sound barriers may extend for miles, the cost of installation takes on special significance. There is a need for a sound barrier that can be erected by installing the panels shortly after the posts are secured to the footings using the same equipment and crew at the location.

A number of highway sound barriers have been invented as typified by U.S. Pat. No. 4,674,593, issued Jun. 23, 1987 to Danny W. McCarty; U.S. Pat. No. 4,887,691, issued Dec. 19, 1989 to Richard J. Rotondo; and U.S. Pat. No. 4,862, 992, issued Sep. 5, 1989 to Nicholas W. Melfi. The patent to McCarty shows the arrangement wherein the support posts are embedded in concrete footings. Melfi shows a support plate mounted on top of the footing and having extensions embedded in the concrete of the footing. The support post is bolted to the support plate. Rotondo shows a support post mounted on top of a concrete footing and having a cable which can adjust the mounting tension between the post and footing.

While the above mentioned patents do teach highway sound barriers, the prior an does not teach the simplicity of construction and ease of installation found in the instant invention.

SUMMARY OF THE INVENTION

The overall object of the present invention is to improve upon the prior an sound barriers by decreasing the time and cost of installation while maintaining a durable and effective construction.

It is a specific object of the invention to effect the connection between a concrete footing and a concrete supporting post without the need of any reinforcing rods embedded in the footing and connected to the post.

It is another object of the invention to provide the top portion of a circular footing with a tapered depression having a flat bottom to support the post in a vertical position while preventing any rocking motion of the post.

It is another object of the invention to reinforce the tapered depression in the top portion of the circular footing with an embedded reinforcing cage surrounding the tapered depression.

It is yet another object of the invention to seal the post in the tapered depression by means of a fast setting grout.

DESCRIPTION OF THE PREFERRED EMBODIMENT

Figure 1:
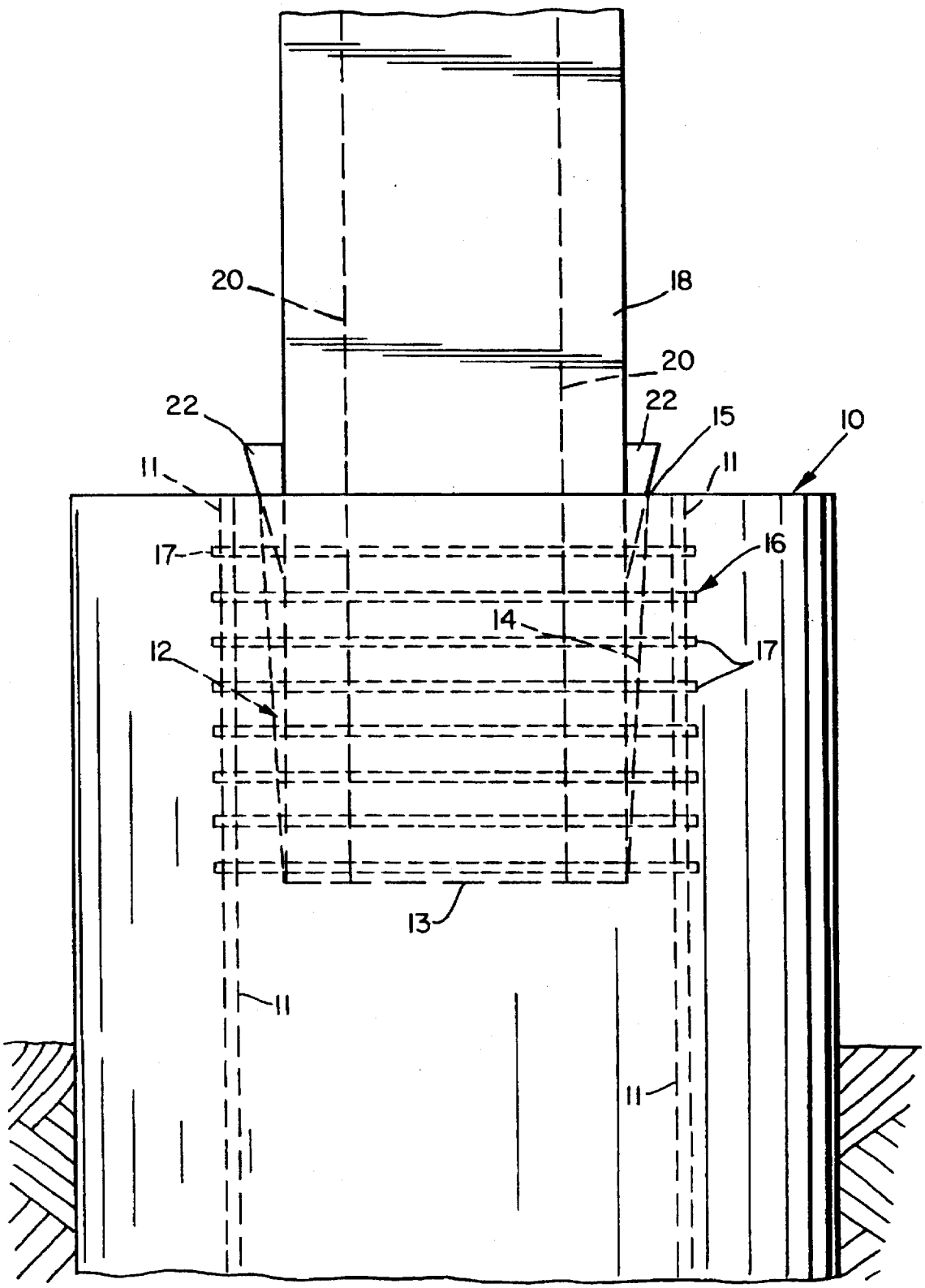
FIG. 1 is a side elevation view of the concrete post supported by the footing.
Figure 2:
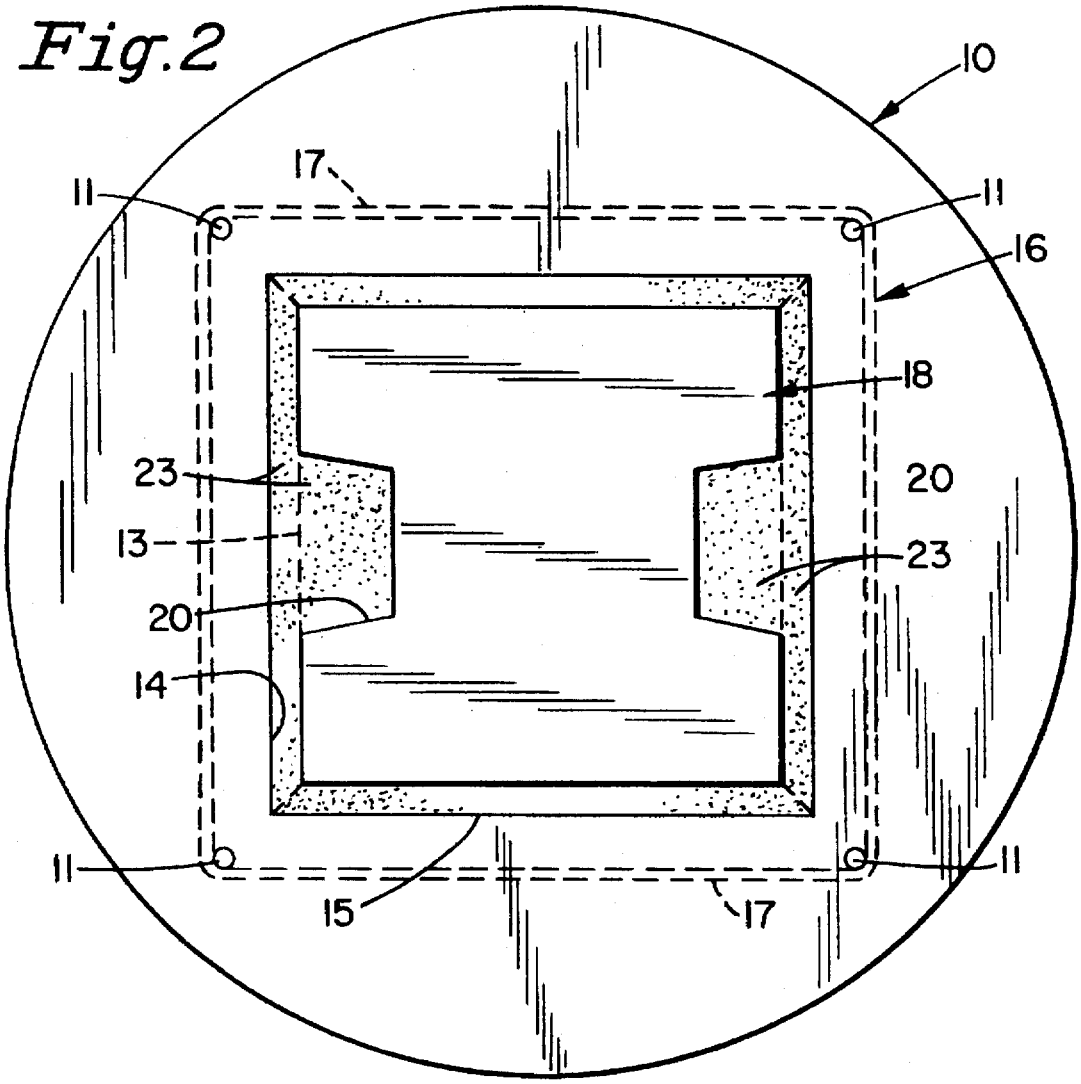
FIG. 2 is a top view of the FIG. 1 construction.
Figure 3:
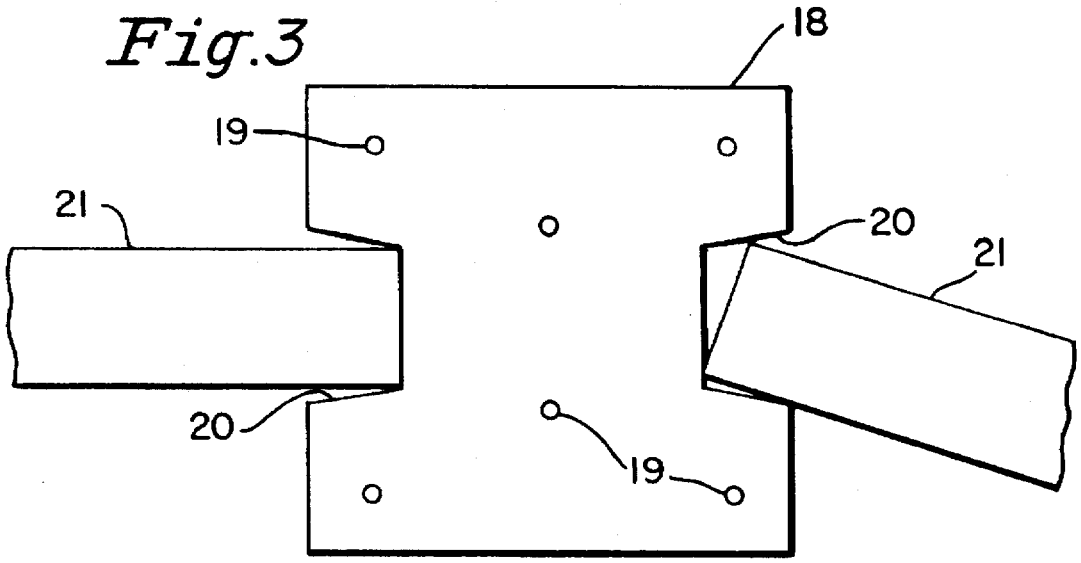
FIG. 3 is a top view of the post in FIG. 1 showing how the panels are supported.

Referring now in general to the drawings and in particular to FIGS. 1–3, the novel concrete past and supporting footing of this invention comprise a circular concrete footing 10 extending into the ground a distance of about 10–20 feet depending on the nature of the soil and the extent of any frost heaving. By way of example only, the footing 10 may be 36" in diameter. The exact size of the footing as well as the required reinforcing rods will depend upon the design loading.

The footing 10 is reinforced throughout its length by footing reinforcing rods 11 which may comprise 4 #9 reinforcing rods located on 21 inch centers. The top of the footing is provided with a depression 12 in the shape of a frustum of a pyramid with a square opening 15. The frustum of a pyramid 12 may have a square base 16" on a side, a square opening 18" on a side, and a depth of 18".

The area at the top portion of footing 10 surrounding depression 12 is reinforced in hoop tension by a reinforcing cage 16 comprising a bank of square reinforcing rods 17 (here shown as 8 square rings of #8 reinforcing rods spaced 2" apart) stacked one above the other to surround depression 12 from top to bottom. The cage 16 surrounds the upper portions of reinforcing rods 11 and in cooperation with the rods strengthens the top region of the footing against any lateral thrusts against tapered side walls 14 by post 18 which will now be described.

Post 18 is generally square in cross section and is made with a flat base which fits squarely on square base 13 of depression 12 as best shown in FIG. 1. Post 18 is made of high strength precast concrete reenforced by means of 6 prestressed cables 19. The tapered connections allow the elimination of the base plates and anchor bolts which allow the prestressing in the post which is cheaper and stronger. The post 18, in the illustrated example, is square in cross-section with 16" sides so as to match the base 13. It extends in a vertical direction above the top surface of the footing for a distance of about 24 feet.

The post is formed with two vertical channels 20 centered on opposite sides and extending for its entire length. The channels are outwardly flared to receive sound absorbing and reflecting panels 21 to be later described. As shown in FIG. 3 with respect to the right panel, the flared construction enables a certain degree of angular adjustment of a panel with respect to a post to accommodate changes in direction. For 5" thick panels, a channel having a 6" opening tapering to a 5" base and a depth of 3" has been found to be satisfactory.

Prior to installing the panels, the post is centered in footing depression 12 and held in a fixed position by means of wood wedges 22 acting between the post and tapered side walls 14. The space between the post and tapered side walls 14 is then poured with a quick setting grout 23 which permanently bonds the post to the footing.

A step-by-step description of the manner of erecting the sound barrier of the invention will now be given. Using a spiral boring tool, a number of holes are bored along the highway at a spacing determined by the length of the barrier panels to be employed. As in conventional practice, a rolled cardboard cylinder is inserted in each bore hole to serve as a form to mold the wet concrete. Prior to pouring a reinforcing rod assembly comprising footing reinforcing rods 11 and reinforcing cage 16 wired together as an assembly is inserted within the cylindrical cardboard form. A removable form (not shown) having an external shape similar to the frustum of a pyramid shape of footing depression 12 is centered within cage 16 so as to be able to displace concrete, leaving behind footing depression 12 after the pyramid shaped form is removed. Concrete is then poured into the cylindrical cardboard form until it reaches a level just even with the opening of the pyramid shaped form. The completed footing is shown in FIG. 1 as having a level top surrounding depression 12.

After the concrete in the footing sufficiently hardens, a precast post 18 of the type discussed above in connection with FIGS. 1 and 3 is vertically installed in footing depression 12 to be seated on base 13. Since the post 18 is of the same square configuration as base 13 it rests squarely on the base. A number of wooden wedges 22 are hammered between the post and tapered side walls 14 to temporarily secure the post.

A quick setting high strength grout is poured into the space between the post and walls 14. After this grout hardens, the wedges can be removed and the spaces left behind filled with grout. The post is now ready to receive panels 21 in vertical channels 20.

Figure 4:
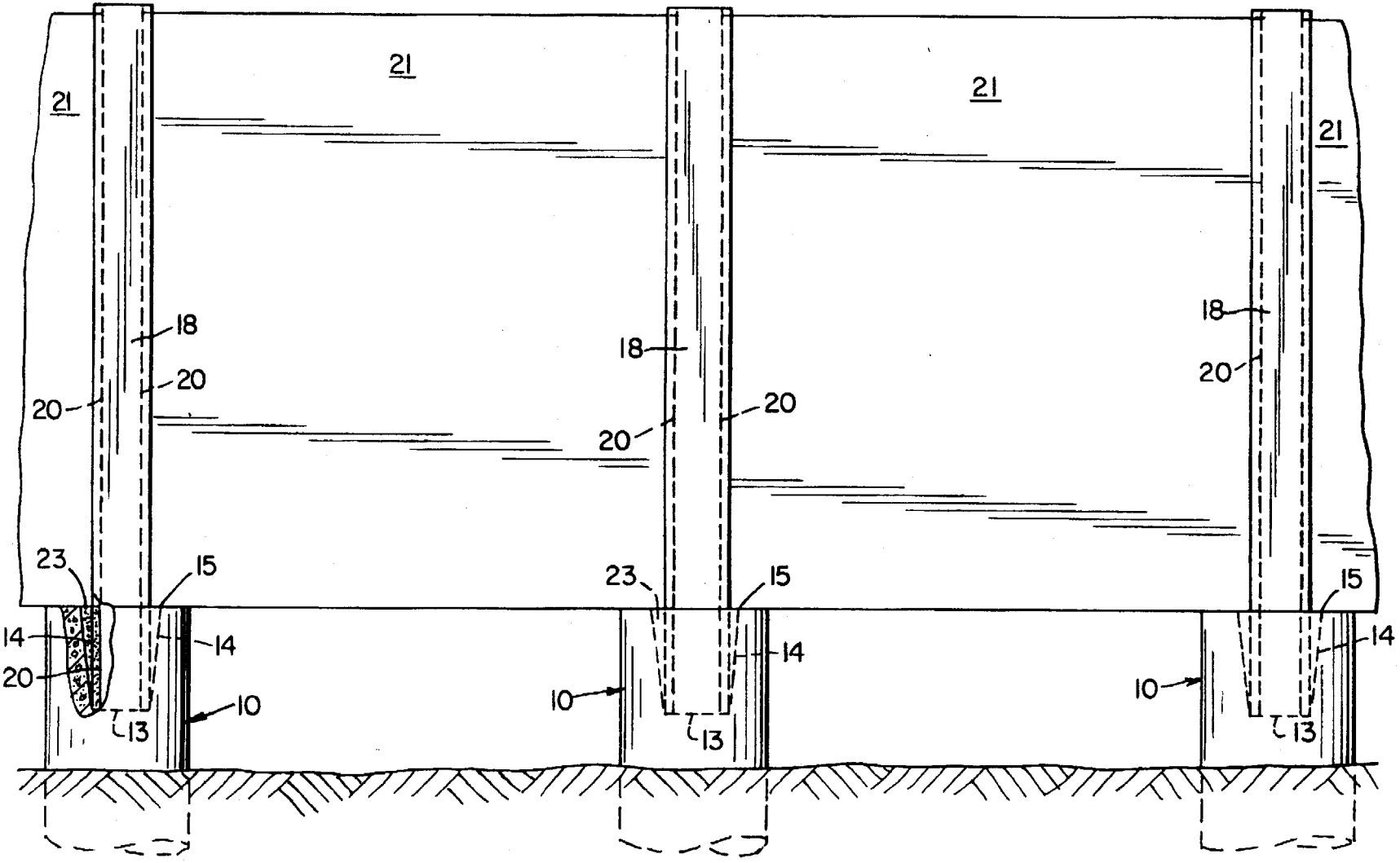
FIG. 4 is an elevation view of a section of an installed sound barrier.

As shown in FIG. 4 a number of posts are spaced along a path to form a sound barrier fence. A panel 21 is raised above the posts and inserted in opposite channels 20 in neighboring posts until the panel rests on top of the footings. The procedure is repeated down the line until all the panels are set in place.

Although the actual details of the construction of the sound absorbing and reflecting panel are not part of the invention, it should be noted that panels having various acoustical properties and decorative exterior surfaces are available and can be employed with the disclosed novel fence posts.

An important advantage in the above described design and installation procedure is the saving in time, labor, and cost over prior designs. In applicant's design, a precast concrete post is set in a depression located at the top of a previously cast footing and locked in place by a high strength, quick setting grout. The top of the footing is reinforced in hoop tension by a reinforcing cage to resist any rocking motion of the post with respect to the footing. Since the grout is quick setting the panels may be inserted in the posts after a waiting time for less than the waiting time required for concrete to cure as in the case of directly embedding the post or its support in poured concrete.

It is not intended to limit the present invention to the details of illustration or terms of description of the single preferred embodiment shown above. It will be appreciated by those skilled in the art that various modifications and alterations therein may be made within the scope of the present invention.

What is claimed is:

1. A fence post combination comprising an elongated, vertical, cylindrical, concrete footing embedded in the ground with a top exposed portion having a flat top, a depression located in a central portion of said flat top, said depression having a base and a plurality of side walls forming an opening in the flat top, a plurality of vertical reinforcing rods embedded in said concrete footing and extending substantially the entire length thereof, said vertical reinforcing rods being arrayed around said depression, a plurality of reinforcing rings embedded in said concrete footing and surrounding said depression, said reinforcing rings and reinforcing rods serving to strengthen said concrete footing surrounding said depression, a precast concrete post vertically mounted in said depression with the bottom of the post seated on the base of the depression, and a quantity of quick setting, high strength grout filling a space in the depression surrounding the post to bond the post to the footing.

2. The combination of claim 1 wherein said depression is in the form of a frustum of a pyramid.

3. The combination of claim 2 wherein said post is stabilized in said depression prior to filling with grout by means of wedges acting between the post and side walls of said depression.

4. The combination of claim 2 wherein said post is generally square in cross section and the base of the post fits squarely on the base of said frustrum of a pyramid.

5. The combination of claim 2 wherein said reinforcing rings are in the shape of a square and are embedded in a stacked relationship surrounding said depression from top to bottom.

6. The combination of claim 1 including a pair of vertical channels oppositely located on said post and extending from the top of the post to the top of the footing.

7. The combination of claim 6 wherein said post is generally square in cross section and said vertical channels are oppositely located on opposite surfaces of the square.

8. The combination of claim 7 wherein said vertical channels are outwardly flared.

9. A fence comprising the combination of claim 8, further including acoustical panels inserted in said vertical channels and contacting the top of said footing.

10. The fence of claim 9 including a plurality of serially spaced posts with an acoustical panel bridging each post pair.

11. A method of making a post for a sound barrier fence, said method comprising the steps of:

(a) boring a hole in the ground for a footing;

(b) placing a concrete reinforcing assembly in said hole comprising an array of vertical reinforcing rods extending from the bottom of the hole to the top, and a stacked array of closed loop reinforcing rods horizontally disposed at an upper location of the vertical rods;

(c) placing an open topped form with tapered side walls and a flat base centrally within the array of closed loop reinforcing rods with the array extending from the top of the form to the bottom;

(d) pouring concrete into said hole, filling said hole and covering said reinforcing assembly to a level of the open top of said form;

(e) removing said open topped form prior to the concrete completely curing, leaving a depression in the top of the footing with an open top, tapered side walls and flat base of a configuration matching the external shape of said open topped form;

(f) vertically mounting a precast concrete post with a flat bottom and opposed sides in said depression with the base of the post resting on the base of the depression, the post being formed with opposed channels on opposite sides of the post; and (g) filling the space between the post and side walls of the depression with a high strength, quick setting grout to bond the post to the footing.

12. A method including providing a plurality of posts made by the method of claim 11 and installing an acoustical panel in opposed channels of a neighboring pair of posts.

13. The method of claim 11 including temporarily securing the post in the depression prior to adding grout by means of wedges acting between the post and side walls of the depression.

* * * * *